US006244991B1

(12) United States Patent
Bingham

(10) Patent No.: US 6,244,991 B1
(45) Date of Patent: Jun. 12, 2001

(54) METHOD AND APPARATUS TO EXERCISE DEVELOPMENTALLY DELAYED PERSONS

(75) Inventor: Anne Bingham, East Northport, NY (US)

(73) Assignee: Theraglide, Inc., New York, NY (US)

( * ) Notice: Subject to any disclaimer, the term of this patent is extended or adjusted under 35 U.S.C. 154(b) by 0 days.

(21) Appl. No.: 09/602,700

(22) Filed: Jun. 24, 2000

Related U.S. Application Data

(62) Division of application No. 09/412,189, filed on Oct. 5, 1999, now Pat. No. 6,080,087.

(51) Int. Cl.[7] ..... A63B 26/00; A61H 3/00
(52) U.S. Cl. ..... 482/69; 602/36
(58) Field of Search ..... 482/69, 23, 43, 482/54, 904; 602/36

(56) References Cited

U.S. PATENT DOCUMENTS 2,675,856 * 4/1954 Abdallah ..... 482/69
3,780,663 * 12/1973 Pettit ..... 104/1
4,252,063 * 2/1981 Brooks, Jr. ..... 128/25 R
5,458,550 * 10/1995 Braim et al. ..... 482/69
5,667,461 * 9/1997 Hall ..... 482/69
5,766,114 * 6/1998 Campbell ..... 482/55

* cited by examiner

*Primary Examiner*—Stephen R. Crow
(74) *Attorney, Agent, or Firm*—Alfred M. Walker

(57) ABSTRACT

An exercise assistive device to help a developmentally delayed person, such as a child, develop vestibular balance and muscle control, so that the child can learn to perform mobility activities, such as crawling, sitting upright, standing or walking. The device includes a support frame having an upstanding base legs with a connecting frame extending therebetween. A body suit glidable support dolly is mounted upon the frame, and travels longitudinally, traversely and rotationally thereupon. The body suit is suspended from the suit glidable support dolly. Flexible connector straps are provided between the body suit and body suit glidable support dolly and made of a material such as reinforced fabric or canvas. These connector straps are positioned in spaced-apart relation to one another about the body suit glidable support dolly. The body suit is suspended from the seat-support leg by the connector straps that extend between the body suit and fasteners. The fasteners upon the body suit are strategically placed to assist the child to assume various postural positions ranging from the upright sitting or standing position, such as at the shoulders, to oblique or horizontal crawling quadruped positions.

10 Claims, 7 Drawing Sheets

MODE OF USE FOR DEVELOPMENTALLY DELAYED CHILD

METHOD AND APPARATUS TO EXERCISE DEVELOPMENTALLY DELAYED PERSONS

This application is a divisional of application Ser. No. 09/412,189 filed Oct. 5, 1999, now U.S. Pat. No. 6,080,087.

FIELD OF THE INVENTION

The present invention relates to methods and devices to promote ambulation in developmentally disabled persons, especially children.

BACKGROUND OF THE INVENTION

The invention relates to a method and apparatus used to help developmentally delayed children exercise specific muscle groups, practice movement strategies and gain strength necessary to sit, to crawl, and to walk.

The prior art is replete with assistive devices. A sampling of the patents in this field is as follows. U.S. Pat. No. 3,721,436 of Barthel, Jr. describes an exercise and walker device that supports an individual in a harness and permits movements over a two-dimensional area and up and down adjustments. However in Barthel, Jr. '436, the harness only holds the person in an upright position, which does not assist the person in quadruped, crawling positions, which are necessary to strengthen arm development and to facilitate vestibular development for better balance, thus preventing the child to easily tip over and injure itself.

U.S. Pat. No. 3,582,069 of Flick and Burke discloses a crawling assistive device that is a sled type with moveable hand and knee pads operated by linkages. It does not describe a body suit or body suit, which can assist a developmentally disabled child from learning to master the quadruped, crawling position as well as transition therefrom to a myriad of other positions while facilitating vestibular development through wide range movement opportunities such as bouncing, rocking and spinning.

U.S. Pat. No. 3,992,023 of Moorer describes a crawling assistive device that is a sled on wheels. It also does not describe a body suit or harness which can assist a developmentally disabled child from learning to master the quadruped, crawling position as well as transition therefrom to a myriad of other positions while facilitating vestibular development.

U.S. Pat. No. 4,569,532 of Mirkarimi illustrates a crawling assistive device similar to Moorer, but one where the child leans forward obliquely. It also does not describe a body suit or harness which can assist a developmentally disabled child from learning to master the quadruped, crawling position while promoting vestibular development through various movement opportunities.

U.S. Pat. Nos. 4,796,903 of Proctor and 5,407,406 of Canela both describe sling type crawling assistive devices of a sling type with harnesses attached to the sling. These devices limit the developmentally disabled child to just the creeping position, thereby restricting transition into alternative postures. In addition, the child's body is in close proximity to a rigid, supportive frame.

U.S. Pat. No. 4,252,063 of Brooks and U.S. Pat. No. 3,780,663 of Pettit both relate to orthopedic supporters to hold a person in a standing position as a harness is moved along a track, similar to the orientation in Barthels, Jr. '436.

Campbell's U.S. Pat. No. 5,766,114 describes an infant walking and swimming aid that includes a harness with shoulder straps to hold the child from above and a chest strap to keep the child upright. However, Campbell '114 does not promote quadruped, weight bearing activities.

Among commercially available devices include the Deltoid Aid arm counterbalance system, which includes slings to hold a forearm in. The slings are supported from above by a frame. A similar sling device lifts a person hydraulically. The Deluxe Vestibulator II by Tumbleforms holds a child horizontally in a sling, but the child's feet lay in the sling and the touching of the hands upon the floor is in a limited, weight-bearing fashion. These devices also prevent the child from developing sufficient strength and orientation needed for creeping and crawling. In addition, the child can fall out of the sling. *These devices limit the developmentally disabled child to just the creeping position thereby restricting transition into alternative postures. In addition, the child's body is in close proximity to a rigid, supportive frame.

In contrast to the prior art devices, the present invention uses a body suit to carefully distribute the stresses placed upon the body by the supporting straps. In addition, multiple attachment points permit the straps to adjustably counteract gravity in such a manner as to assist a child in attaining sitting, standing and crawling postures. Along with a supporting frame and track, as provided in several of the prior art devices, exercise and conditioning is tailored to the developmentally delayed child.

OBJECTS OF THE INVENTION

It is therefore an object of the present invention to help developmentally delayed children exercise specific muscle groups, practice movement strategies and gain strength necessary to sit, to crawl, and to walk.

It is also an object of the present invention to help the developmentally delayed child to master the sitting position.

It is also an object of the present invention to provide an exercise device, which promotes a "righting" response that will cause a developmentally disabled child to assume an upright position.

It is also an object of the present invention to develop a protective arm response in a developmentally disabled child in order to prevent the child from falling, and to maintain upright balance.

It is also an object of the present invention to provides a device, which promotes dynamic, wide range neck and trunk control exercise opportunities, which are essential and foundational to all other physical development.

It is also an object of the present invention to assist the person in quadruped, crawling positions.

It is also an object of the present invention to strengthen arm development and to facilitate vestibular development for better balance.

It is also an. object of the present invention to assist a developmentally disabled child from learning to master the quadruped, crawling position while facilitating vestibular development.

It is also an object of the present invention to provide a frame-supported body suit, which can safely assist a developmentally disabled child from learning to master the quadruped, crawling position.

It is also an object of the present invention to promote quadruped, weight bearing activities in a developmentally disabled child.

It is also an object of the present invention to lift gravity off of the developmentally delayed child, thereby making it possible for the child to assume weight bearing positions that they would otherwise probably not be able to assume.

It is another object of the present invention to promote an upright standing posture and weight bearing through the legs in preparation to walk.

It is yet another object of the present invention to allow a therapist to modulate their therapeutic handling of a child and change positions with simple adjustments.

It is yet another object of the present invention to provide a device, which permits the disabled child to make movement choices and to positively interact with the environment.

It is yet another object of the present invention to enable developmentally delayed children to learn where they are in space in relation to other objects, to help them learn depth perception.

It is yet another object of the present invention to enable a developmentally disabled child to ambulate safely.

It is yet another object of the present invention to provide a device that allows a developmentally delayed child to exercise and to facilitate transition into several postural and ambulatory positions.

It is yet another object of the present invention to improve over the disadvantages of the prior art.

SUMMARY OF THE INVENTION

In keeping with the aforementioned objects and others which may become apparent, the present invention relates to an exercise assistive device to help a developmentally developed person, such as a child, develop vestibular balance and muscle control, so that the child can learn to perform mobility activities, such as crawling, sitting upright, standing or walking.

Structurally, in a preferred embodiment, the device includes a support frame having a upstanding base legs with a connecting frame extending therebetween.

A body suit glidable support dolly is mounted upon the frame, and travels longitudinally, traversely and rotationally thereupon.

The body suit is suspended from the suit glidable support dolly.

Flexible connector straps are provided between the body suit and body suit glidable support dolly, and are made of a material such as reinforced fabric or canvas. These connector straps are positioned in spaced-apart relation to one another about the body suit glidable support dolly.

The body suit is suspended from the frame by the connector straps that extend between the body suit and fasteners attached to the glidable support dolly. Each connecting strap is connected to a respective fastener upon the body suit support frame of the glidable support dolly at one end and to a further fastener upon the body suit.

Those fasteners upon the body suit are strategically located to assist the child assume various postural and/or ambulatory positions ranging from the upright sitting or standing position, wherein the straps are connected at the shoulders, to oblique or horizontal crawling quadruped positions, wherein the straps are connected at the rear hip area.

The preferable configuration of strap attachments is similar to those connected to the torso area of a marionette.

This configuration facilitates the vertically upright, oblique or horizontal positions.

A height adjustment member is provided to hold the child at a predetermined height, which can be adjusted up or down, to enable the child to move down to a hand and knee weight bearing crawling position, or up therefrom in a non-weight bearing, suspended position from above.

Although the device can be used for any person, including disabled adults, the above noted assistive exercise body suit and track system is primarily designed for developmentally disabled children.

In operation, a developmentally disabled child is placed in the body suit outfit and the set of fasteners are connected to the body suit to maintain the child in the aforementioned upright sitting position, primarily located in the shoulder areas. The further sets of fasteners are attached to the rear hip area to help to facilitate the child in a quadruped, crawling position.

An optional set of fasteners is also provided in the side front abdominal area to maintain the child in a standing position, in conjunction with the rear shoulder fasteners. Other fasteners can also be provided in the front chest area.

The fasteners are connectable to the flexible but inelastic fabric connector cords or straps, such as polypropylene straps, similar to that used in backpack straps. These straps are connected to the glidable support dolly, which is slidably movable back and forth in axial directions along a pair of primary tracks of the support track system. The. support dolly preferably includes wheels or rollers engagable with the respective primary tracks.

In a preferred embodiment, the support dolly comprises a further set of secondary tracks placed perpendicular to the axis of the primary tracks. The dolly therefore includes a further dolly support which is movable along the secondary tracks, in opposite directions which are transverse to the axial direction of the primary tracks.

Such configuration is similar to a gantry, which moves in three axes, namely front, back and sideways.

Furthermore, the primary dolly support tracks are supported by upright stanchions, or by arches.

In yet a further embodiment, a rotating wheel attached to the glidable support dolly allows for rotational directional change while the dolly moves along the tracks.

Therefore, the present invention is a method and apparatus used to help developmentally delayed children exercise muscle groups necessary to sit, crawl (creep) and walk.

This multi-functional therapeutic device comprises a body suit with an overhead suspension system. The body suit is custom fit to each child. It includes fasteners on suit, which allow for position change. The overhead system includes a dolly that runs along a primary track.

When the child begins to move, the overhead system responds allowing the child to "feel" a slight falling sensation which will create an opportunity for a postural response to stay upright that will cause the child to come upright. The child is safe from hitting the ground because of straps, which suspend the child from the suit to an overhead assembly. This overhead assembly may include a rotational bar, which allows for rotational directional change along the track. The system may also include a buoyancy feature provided by a compression spring within the overhead system. This means that the child will experience a bouncing sensation, which helps to elicit further attempts to move and exercise.

In developmentally advanced children, weight bearing is essential in typical development. Such a child first learns to hold his or her head upright while developing a "protective arm response" in order to prevent a fall and maintain balance.

After this crucial milestone is achieved, a typical developmentally advanced child then learns to come up on its forearms and eventually on extended arms. This weight bearing through the arms prepares them for creeping.

Eventually, a typical developmentally advanced child likewise bears weight through the legs in preparation for walking.

In contrast, the developmentally delayed child, however, due to an underlying neuro-muscular impairment is often too weak to begin this process, or might achieve some of it yet at a much slower pace.

The severely disabled child may never achieve these milestones at all.

Therefore, the present invention is designed to lift gravity off of the developmentally delayed child, making it possible for them to assume weight bearing positions that they would otherwise probably not be able to assume.

With respect to upright sitting positions, most children learn to sit up by six to eight months old. Prior to achieving this milestone, they have had hundreds and thousands of opportunities to practice this basic skill, including slight rocking front to back and side to side while in their mother's arms or up against a crib side, for example.

Unlike typical developmentally advanced children, the developmentally delayed child is too weak to attempt this basic rocking practice. The first place to start treating a developmentally delayed child is then in the sitting position. The child is placed in the body suit and fasteners on the body suit at about the front and back shoulder area are attached to the connector straps that suspend the weight of the child to an overhead rail.

As the child moves, the dolly responds accordingly, allowing the child to experience a "falling sensation". In order to come upright, the child must use muscles in the neck and trunk area, as well as the abdominal.

These attempts to right themselves provides these children with the much-needed opportunity for exercise.

To date, there is no other prior art which provides such dynamic, wide range exploration to the postural system. Yet, neck and trunk control exercise opportunities are essential and foundational to all other physical development.

To begin treating a developmentally disabled child in the present invention, one would first need to evaluate the child's physical condition. If the child has not yet achieved head and trunk control, this would probably be the best place to start. The child is placed in sitting and the therapist or attendant determines the tension on the glider, which rolls above in response to the child's attempt to sit. The therapist also determines the length of travel along the rail.

For example, a severe child only needs a short distance, of perhaps six inches in all directions to begin learning to sit upright.

If after some degree of head and trunk control is achieved, or if therapists determine it to be beneficial, the child is then placed on all fours in a quadruped position in preparation to creep. The fasteners are placed on the upper and lower back portions of the suit. Again, the therapist or attendant determines the level of difficulty in tension and length of travel.

Likewise, standing is then attempted by placing the child in front and back upper fasteners and by height adjustment on the rotational overhead assembly, so that the child's feet touch. the floor in order to weight bear.

This system of the present invention allows a therapist to modulate their therapeutic handling of a child and to change positions with simple adjustments. Unlike other equipment used to exercise developmentally delayed children, the present invention does not limit a child to a single postural or ambulatory position. It allows the child to practice movement strategies, make movement choices and interact with the environment.

Many developmentally delayed children need to learn where they are in space in relation to other objects, such as the floor or mirror for example, which could be placed near the child to help them learn depth perception.

Many developmentally delayed children also suffer from sensory perception problems. For example, many have visual problems which make ambulating about the house in a conventional walker dangerous. They can fall down a step or bump into furniture, often hurting themselves. Unlike most other devices used by developmentally delayed children, the device of the present invention provides an opportunity for the impaired child to learn how to control his/her own body without being strapped in or down to a hard, rigid cage or walker, which must then be carried about with them.

Feeling their own bodies move and touching the floor gives these children "proprioceptive input", which is desperately craved by many developmentally delayed children. They enjoy the sensation of bouncing and spinning because it provides vestibular input into the brain, which causes them to become more alert and able to respond more appropriately to their environment.

BRIEF DESCRIPTION OF THE DRAWINGS

The present invention can best be understood in conjunction with the accompanying drawings, in which.

DETAILED DESCRIPTION OF THE PRESENT INVENTION

Figure 1:
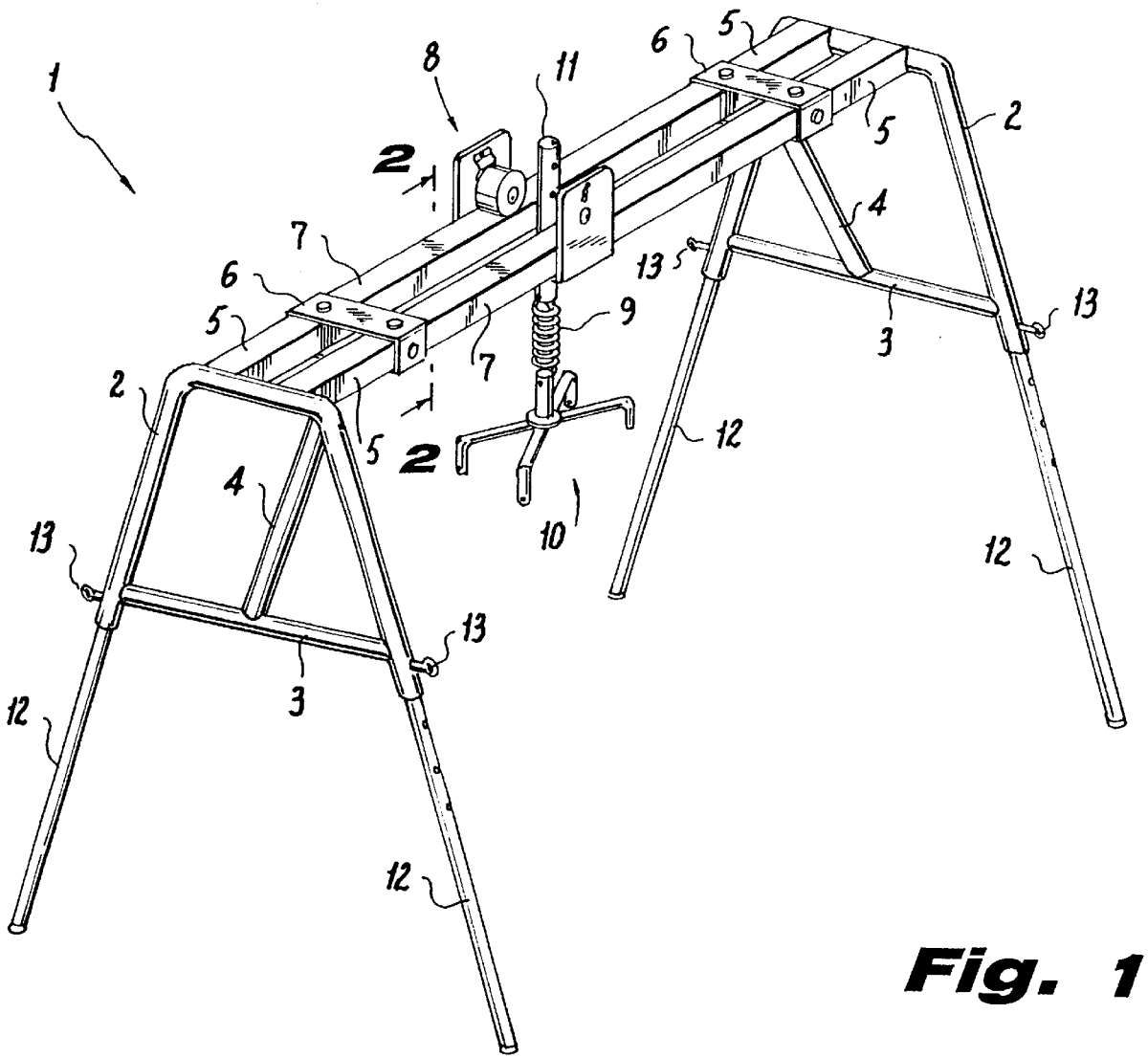
FIG. 1 is a perspective view of a support track apparatus of the present invention intended for home use.

The frame 1 of the gliding support device of the present invention shown in FIG. 1 is intended for home use. As such, it is constructed of lightweight steel or aluminum tubing with features for ease of transporting and assembly.

Although many difficult structural configurations are applicable, in the preferred embodiment, the two top end sections are pre-assembled and include welded parts for maximum rigidity. They each have a bent tubing member 2, cross brace 3, rail end extensions 5, rail attachment member 6 and angled brace 4. The structure is completed by adding rails 7 and legs 12 which have a telescopic fit in end sections 2 and are adjustable for height with the aid of pring pins 13 which fit in the desired adjustment hole. A rolley subassembly 8 completes the home support track.

Figure 2:
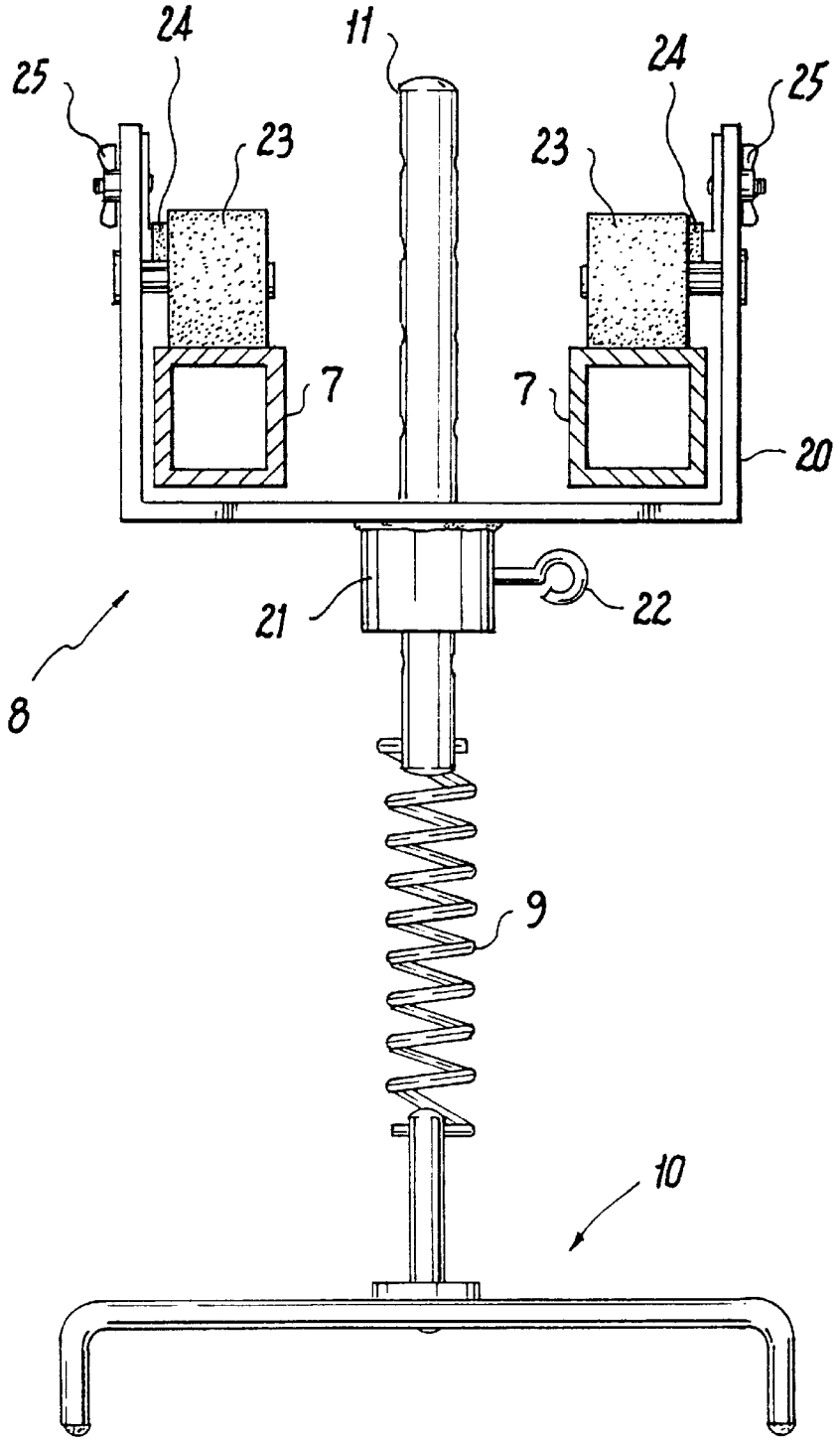
FIG. 2 is an end view of a support trolley of the present invention for a home system.

FIG. 2 shows details of trolley 8 including frame 20, support rollers 23 (which roll on the top surface of rails 7), adjustable height rod 11, collar 21, and spring pin 22 for adjusting height.

Also included is an adjustable drag feature, which includes brake pads 24, mounted on short lengths of leaf spring. The pressure of pads 24 against the inner side of rollers 23 can be adjusted from no contact to a preset maximum by adjusting wing nut 25.

Since the rollers 23 have ball bearings, for certain stages in child development and for certain exercises, the momentum of suspended child can be disconcerting if high speeds are achieved. This drag adjustment can control the maximum speed and also the amount of effort required for the child to move. This latter factor can be used in supervised settings to improve exercise effort.

An extension spring 9 is used to suspend attachment arms 10, which will be used to attach the child's body suit straps. Arms 10 can rotate freely at the bottom spring 9 attachment.

Figure 3:
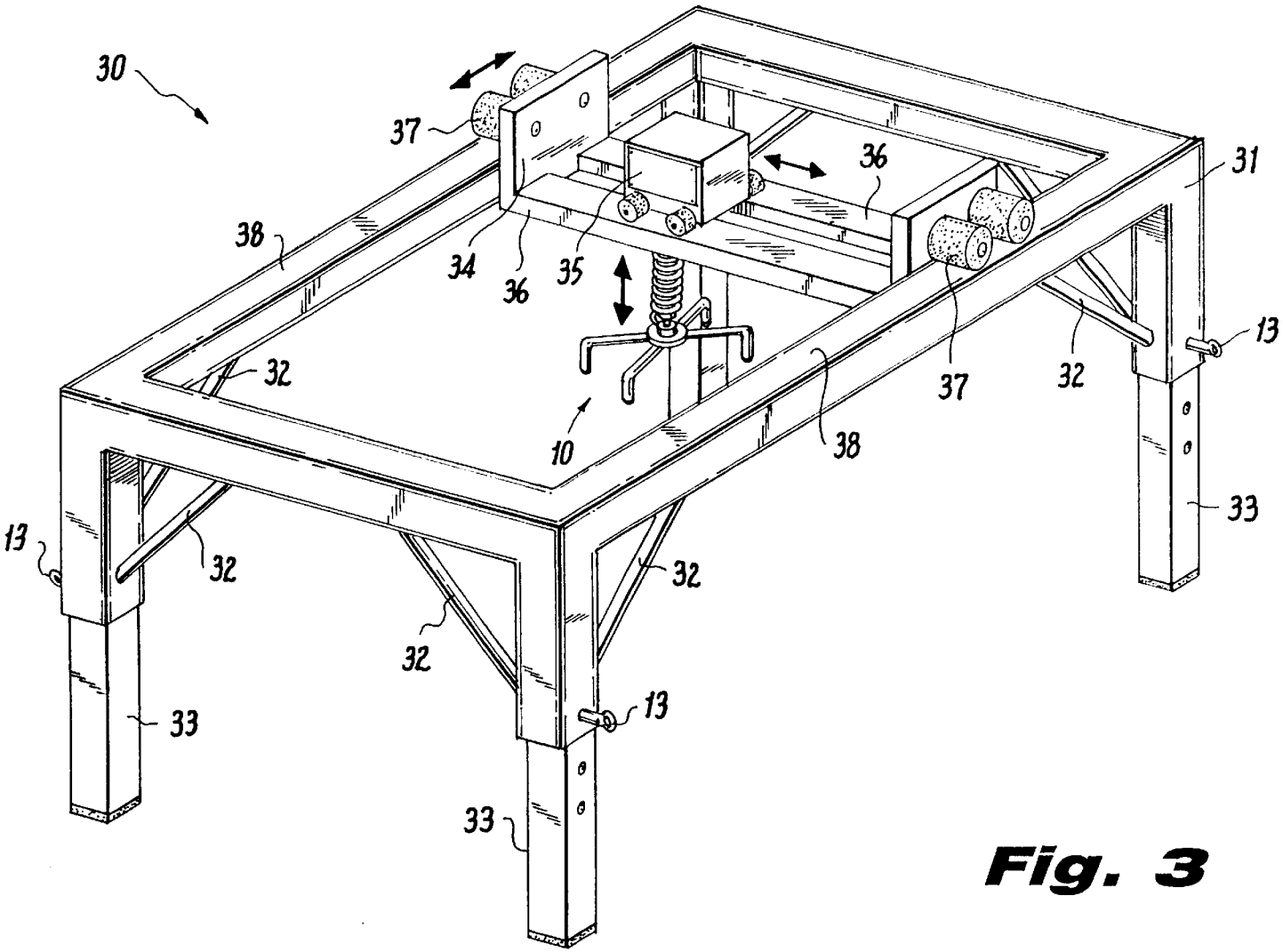
FIG. 3 is a perspective view of support track apparatus of the present invention for a therapy center.

FIG. 3 shows an alternate embodiment of the support track apparatus for a health center or a therapeutic center. The physical size as well as the structural strength is superior to the home version. This apparatus can also be used for rehabilitation of adults with a variety of injuries such as spinal surgery recovery.

Frame 31 includes square metal structural tubing with angled braces 32. Telescoping bottom leg sections 33 are used to adjust frame height by using spring pins 13 in appropriate adjustment holes. The top surfaces 38 of longitudinal members are used to support the rollers 37 of a gantry carriage 34 with cross rails 36. Trolley subassembly 35 rolls on rails 36. The suspension arms 10 can be positioned over any spot within the contours of frame 31 through the combination of longitudinal rolling on surfaces 38 and crosswise rolling on rails 36. Mechanical stops (not shown) can be clamped onto rails 36 or 38 to limit the travel in either orthogonal direction as desired.

Figure 4:
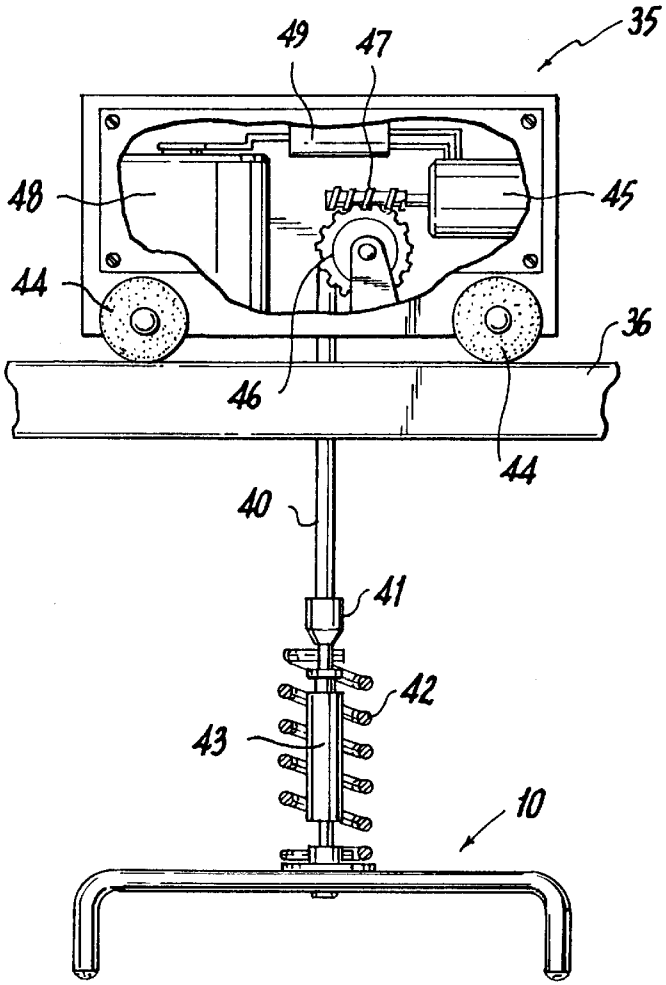
FIG. 4 is a side view of support trolley subsystem of the present invention with the cover shown removed.

FIG. 4 is a side view of trolley subassembly 35 with the access panel removed to show the components within. Rollers 37 as well as rollers 44 can be equipped with adjustable drag brakes (not shown) as discussed for the previous embodiment. Trolley 35 is equipped with a remote controlled electric winch to raise or lower attachment arms 10.

Figure 5:
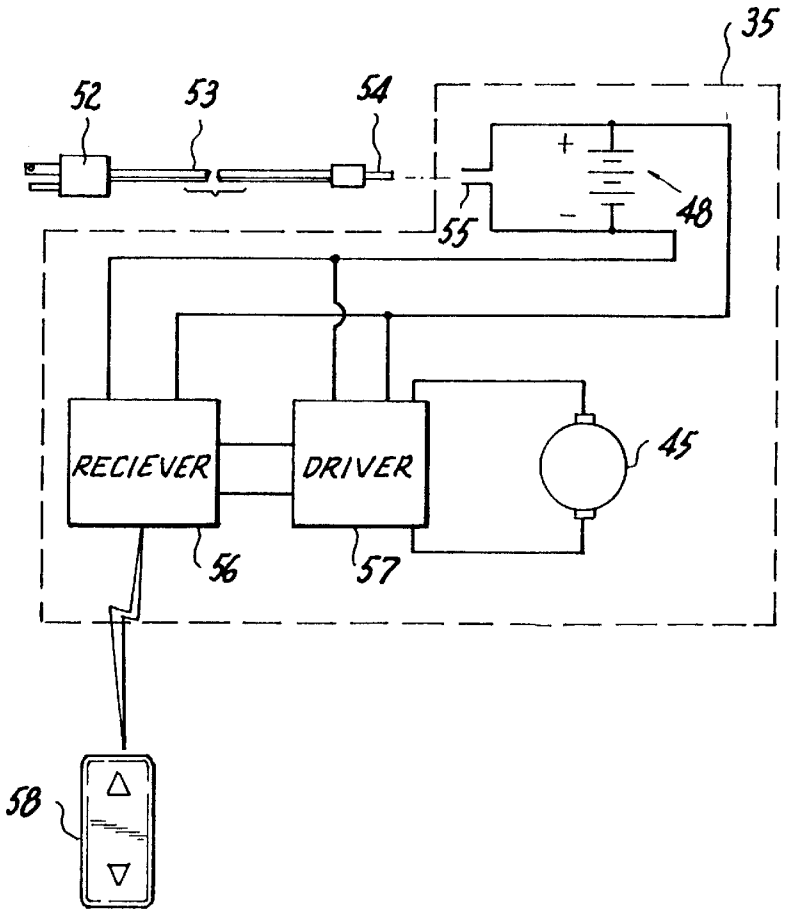
FIG. 5 is an electrical block diagram support trolley subsystem of the present invention.

FIG. 5 is an electrical block diagram of this subassembly. The winch consists of drum 46 with spur gear engaging worm pinion 47 driven by gear motor 45. The worm 47 pitch is selected to prevent overrunning so that cable 40 cannot be pulled out further once motor 45 has stopped. A rechargeable battery 48, similar to nickel cadmium types used in industrial portable drills, supplies power to receiver/driver 49 which, in turn, controls and powers motor 45.

A wall mounted battery charger 52 is plugged into socket 55 during non-use hours to recharge battery 48 (e.g.—over night). A long cord 53 is-used to facilitate this. A radio frequency communications protocol is used from remote control 58 to receiver 56 so that the therapist's eyes need not be moved from the patient during height adjustment.

Remote control 58 has only two buttons, UP and DOWN. If an infrared control link were used as in TV remote controls, a general line of sight aiming would have to be used. The radio frequency link is omni-directional and is not impaired by structural members that would interfere with an infrared signal.

Driver 57 spins motor 45 in the desired direction upon command from remote control 58 to raise or lower cable 40. Cable ferrule 41 has a loop to accept extension spring 42 as well as concentrically located adjustable damping element 43, which can either be a pneumatic dashpot or a hydraulic shock absorber. These velocity sensitive elements are used to adjust the amount of "bounce" as desired. Bounce is often used as an incentive to initiate movement, but too much bounce can cause injury.

Figure 7:
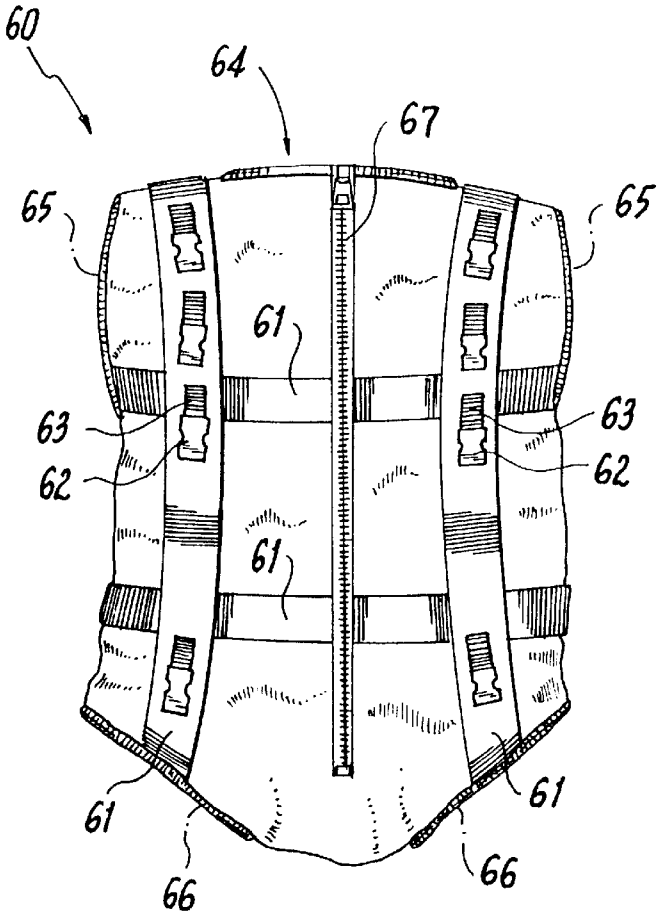
FIG. 7 is a rear view of body suit of the present invention.
Figure 6:
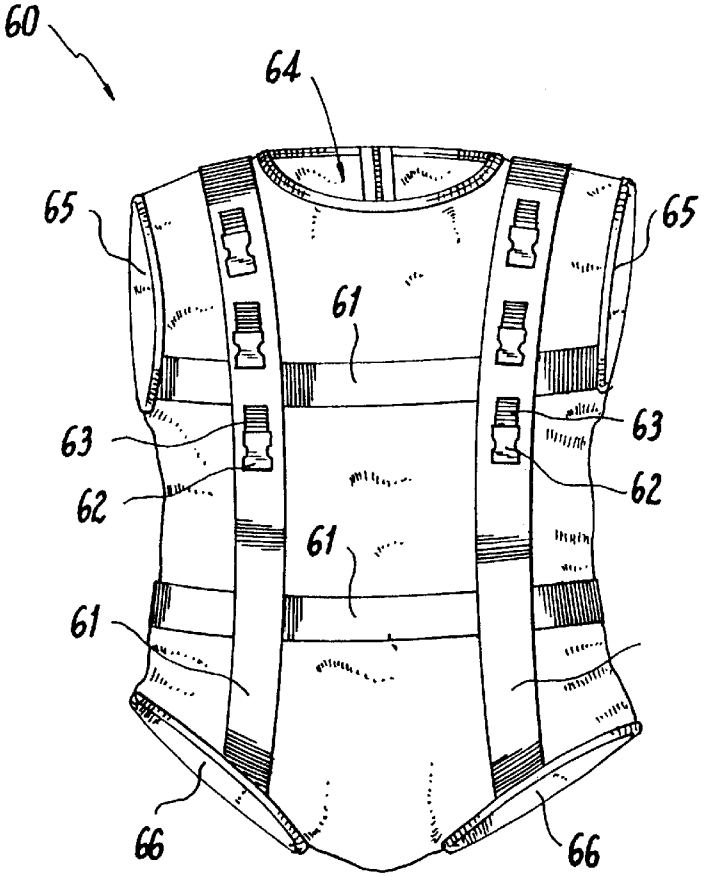
FIG. 6 is a front view of body suit of the present invention.

FIGS. 6 and 7 show the front and back of body suit 60 respectively. It is made of sturdy machine washable cotton fabric and is a custom fit for the child. A zipper 67 opens the back for easy donning and removal. Reinforcing webbing 61 is added where the sturdy connector clips 62 are fastened with their own webbing tabs 63.

Depending on the size of body suit 60, the middle pair of clips 62 on the front and the back may be eliminated if the spacing is too constrained. Also there may be no lower pair of front clips (as on the back side) since these would cause a danger of toppling if used.

The lower back. pair is only used for the creeping or "quadruped" position. The upper clips 62 on the front and back are used to position for sitting, kneeling or standing positions. The neck opening 64, arm holes 65 and leg openings 66 complete the design which distributes the point stresses of straps attached to clips 62 over a large area.

Figure 8:
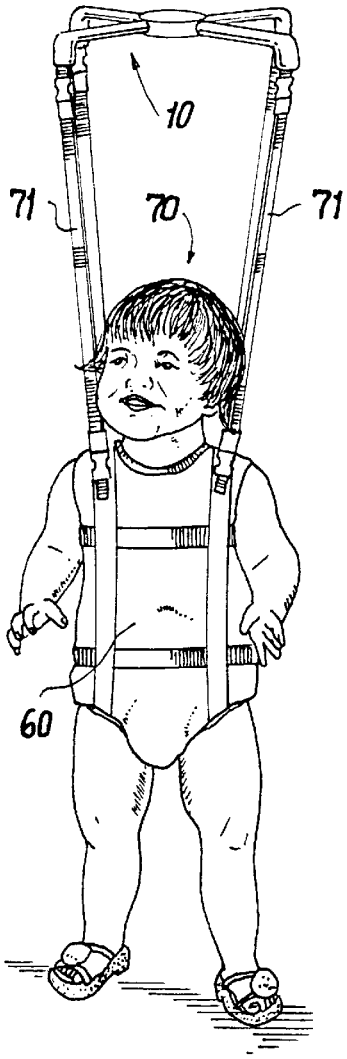
FIG. 8 is a front view of a standing child using the present invention.

FIG. 8 shows a child 70 wearing body suit 60 suspended by straps 71 attached to support arms or frame 10. The suspension is similar to that used by a marionette. Straps 71 are of nylon webbing with length adjuster buckles (not shown) or if more "bounce" is desired, an elastic material may be used for straps 71.

Figure 9:
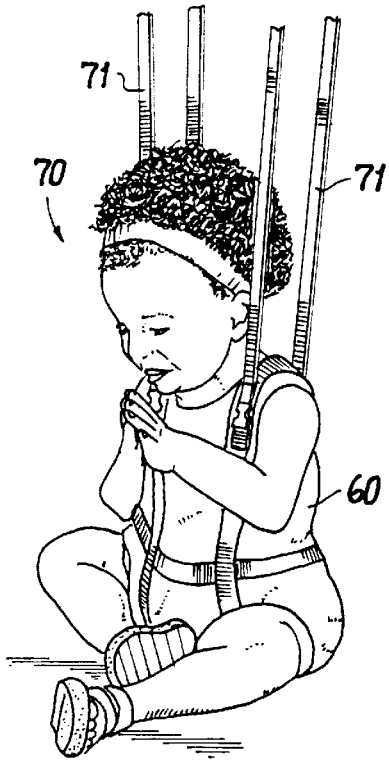
FIG. 9 is a rear view of sitting child using the present invention.

FIG. 9 shows child 70 in a suspended seating position.

Figure 10:
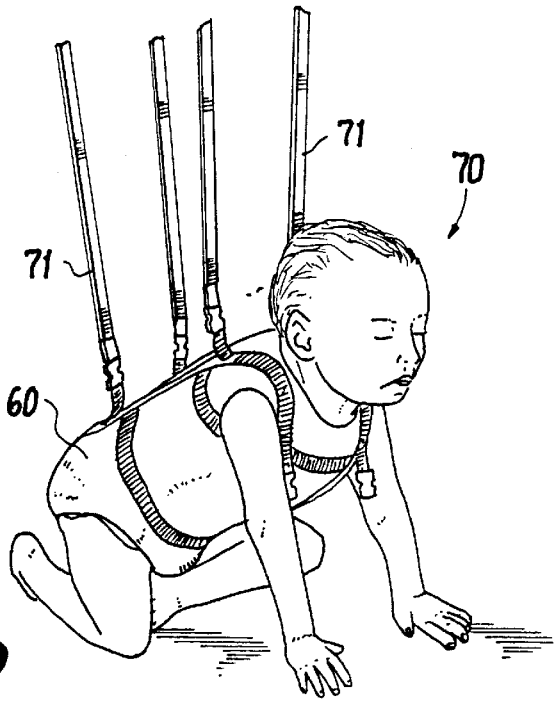
FIG. 10 is a side view of crawling child using the present invention.

FIG. 10 shows the use of the back attachments to support the child in a creeping position.

METHOD OF USE AND OPERATION

Figure 11:
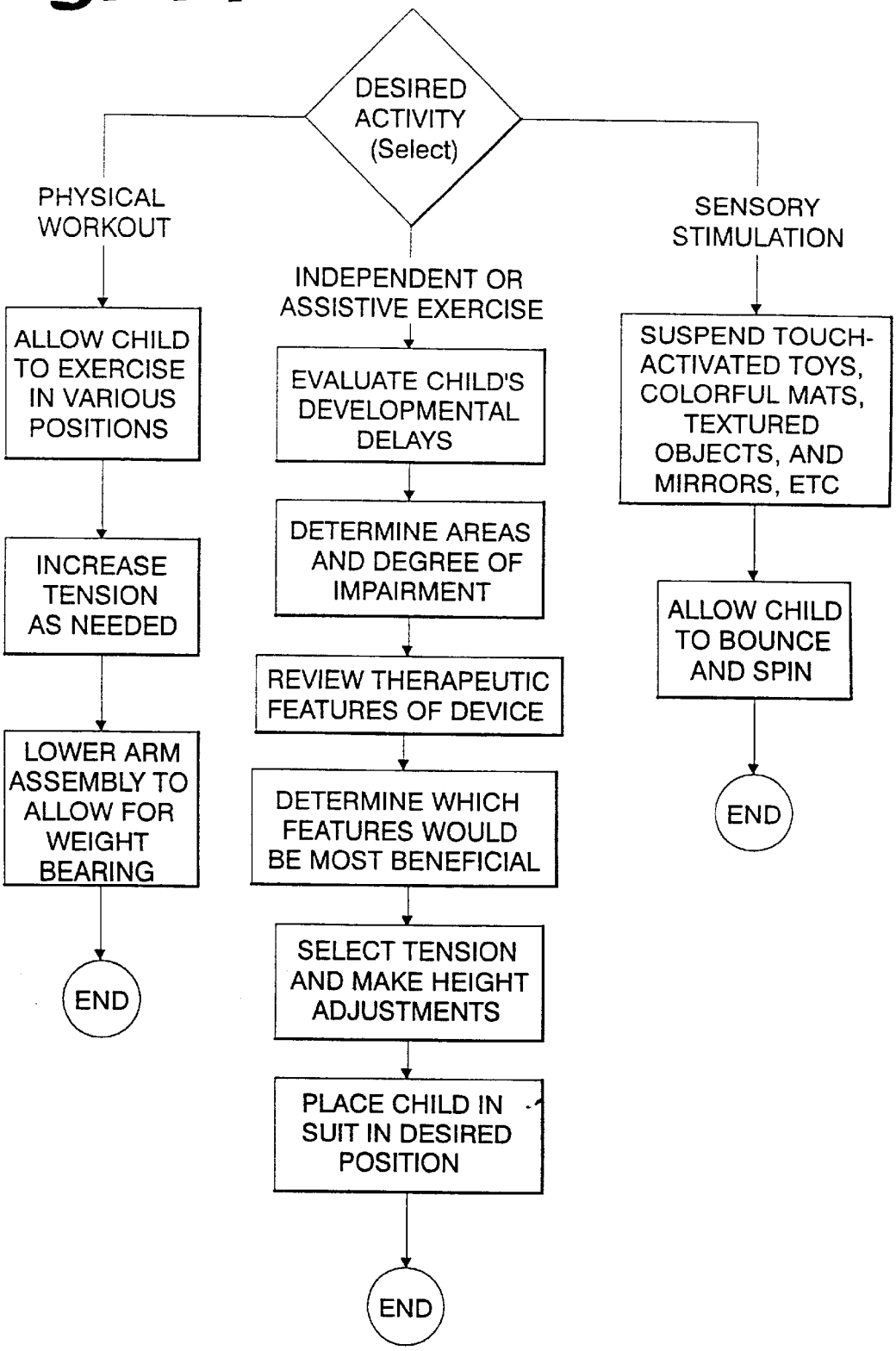
FIG. 11 is a flowchart illustrating modes of use for the apparatus of the present invention.

FIG. 11 is a flow chart illustrating the various modes of use of the apparatus for a developmentally delayed child. The left branch illustrates the use for a physical workout. The various roller resistance adjustments and height adjustments are used to optimally regulate the fraction of gravity force acting on the child in the various desired positions. The central branch is more of a diagnostic and evaluative flow that would probably be administered by a trained therapist. The right hand branch is a sensory stimulation use of the equipment.

EXAMPLE OF USE AND OPERATION

An experienced therapist observed two children using the apparatus of the present invention similar to that shown in FIGS. 1–2 and 6–10. One child had low tone and generalized weakness while the other child was with cerebral palsy and showed signs of spastic quadruparesis. The therapist was impressed by the versatility of the apparatus as she watched one child transition from quadruped to sitting to standing positions with "minimal and easy adjustments". She observed the "fluidity of movement" the child was able to demonstrate with the apparatus. The equipment allowed the child to experiment with a variety of movement strategies and options to interact with her environment. In addition to observing, the therapist also worked with the child with spastic quadruparesis using the apparatus of the present invention. The therapist concluded that she was able to modulate her own handling and positioning techniques since the apparatus provided "additional hands" to support the child thus creating greater positioning options. Unlike interaction with rigid surfaces, "the child was able to move, and then experience the consequences of his movement within a safe parameter".

The aforementioned embodiments are merely illustrative of several configurations for the present invention. Therefore, it is further noted that other modifications may be made to the present invention, without departing from the scope of the invention, as noted in the appended Claims.

I claim:

1. A method used to help developmentally delayed persons exercise specific muscle groups and gain strength necessary to sit, to crawl, and to walk, comprising the steps of:

providing an exercise and walker device that supports a person in a body suit and permitting movements of the person over a three dimensional area with up and down adjustments;

said body suit holding the person in upright, oblique and horizontal positions, to assist the person in quadruped, crawling positions;

placing the person alternately in weight bearing and non-weight bearing positions to strengthen arm development and to facilitate vestibular development for better balance, thus preventing the person to easily tip over and injure itself;

permitting the body suit to adjustably counteract gravity in such a manner as to assist the person in attaining sitting, standing and crawling postures;

positioning the person to develop a protective arm response to prevent the person from falling, and to maintain upright balance.

2. The method as in claim 1 wherein the person is supported by said support frame having a upstanding base legs with a connecting frame extending therebetween; wherein further, the person travels longitudinally, traversely and rotationally thereupon.

3. The method as in claim 1 further comprising the step of assisting the person to assume various postural positions ranging from the upright sitting or standing position, such as at the shoulders, to oblique or horizontal crawling quadruped positions, such as at the rear hips area.

4. The method as in claim 1 further comprising the step of holding the person at a predetermined height, which can be adjusted up or down, to enable the person to move down to a hand and knee weight bearing crawling position, or up therefrom in a non-weight bearing, suspended position from above.

5. The method as in claim 1 further comprising the step of slidably moving the person back and forth in axial directions and moving the person, in opposite directions which are transverse to the axial direction of the first directions.

6. The method as in claim 5 wherein the person is moved in three axes.

7. The method as in claim 5 further comprising the step of rotating the person.

8. The method as in claim 5 further comprising the step of teaching the person to hold his/hers head upright while developing a protective arm response in order to prevent a fall and to maintain balance.

9. The method as in claim 5 further comprising the step of placing the person in sitting position to determine the tension needed to upright the person upon tipping obliquely, determining a length of travel, and placing the person on all fours in a quadruped position in preparation to crawl.

10. The method as in claim 9 further comprising the step of moving the person gradually to touch the floor to give the person proprioceptive input, to facilitate the sensation of bouncing and spinning to provide vestibular input into the brain.

* * * * *